US005932522A

United States Patent [19]

Bell et al.

[11] Patent Number: 5,932,522

[45] Date of Patent: Aug. 3, 1999

[54] SUPERCONDUCTING RADIO FREQUENCY BANDSTOP FILTER

[75] Inventors: H. Clark Bell, Chatsworth, Calif.; Henry John Muller, Arlington Heights, Ill.

[73] Assignee: Illinois Superconductor Corporation, Mt. Prospect, Ill.

[21] Appl. No.: 08/721,470

[22] Filed: Sep. 27, 1996

[51] Int. Cl.[6] ..... H01P 2/01; H01B 12/02

[52] U.S. Cl. ..... 505/210; 505/700; 505/866; 333/99.005; 333/176; 333/202; 333/219

[58] Field of Search ..... 333/219, 222, 333/223, 995, 176, 202, 202 HC; 505/210, 700, 701, 866

[56] References Cited

U.S. PATENT DOCUMENTS

| | | | |
|---|---|---|---|
| 4,382,238 | 5/1983 | Makimoto et al. | 333/134 |
| 4,449,108 | 5/1984 | Endo et al. | 333/202 |
| 4,700,158 | 10/1987 | Dorsey | 333/202 |
| 5,032,807 | 7/1991 | Petrovic | 333/202 X |
| 5,106,826 | 4/1992 | Alford et al. | 505/700 X |
| 5,616,539 | 4/1997 | Hey-Shipton et al. | 333/176 X |

FOREIGN PATENT DOCUMENTS

| | | | |
|---|---|---|---|
| 140901 | 7/1985 | Japan | 333/202 HC |

OTHER PUBLICATIONS

Lancaster, M.J. et al; "Superconducting Microwave Resonators"; *IEE Proceedings–H*; vol. 139; No. 2; Apr. 1992; pp. 149–156.

Bell, H. Clark, "L–Resonator Bandstop Filters", 1996 IEEE MTT–S International Microwave Symposium Digest, pp. 1–4.

Bell, H. Clark, "Narrow Bandstop Filters", *IEEE Transactions on Microwave Theory and Techniques*, vol. 39, No. 12, pp. 2188–2191 (Dec. 1991).

Hunter et al., "Electronically Tunable Microwave Bandstop Filters", *IEEE Transactions on Microwave Theory and Techniques*, vol. MTT–30, No. 9, pp. 1361–1367 (Sep. 1982).

Matthaei et al., "Microwave Filters, Impedance–Matching Networks, and Coupling Structures", Artech House Books, Dedham, MA, Chapter 12, pp. 725–773 (1964).

*Primary Examiner*—Benny T. Lee
*Attorney, Agent, or Firm*—Marshall, O'Toole, Gerstein, Murray & Borun

[57] ABSTRACT

A bandstop filter contains one or more resonant circuits connected by interconnecting transmission lines. The resonant circuits each have a transmission line connected between two capacitors. One capacitor is connected to the interconnecting transmission line and the other capacitor is connected to ground. The resonant circuits may have a helical coil of superconducting materials as the transmission line. The capacitors may be in the form of screws, which can be inserted into or removed from the center of the helix. The helix may be formed as a discrete structure and supported by a low-loss material within a housing.

19 Claims, 5 Drawing Sheets

SUPERCONDUCTING RADIO FREQUENCY BANDSTOP FILTER

FIELD OF THE INVENTION

The present invention relates generally to electromagnetic bandstop filters, and more particularly to filters which efficiently attenuate signals having relatively long wavelengths.

BACKGROUND OF THE INVENTION

Bandstop filters are designed to attenuate bands of unwanted signals which are input into the filter. A conventional bandstop filter, as seen in FIG. 1, generally includes an input 10 and an output 12 connected by interconnecting transmission lines 14. A number of resonators 16 are connected along the interconnecting transmission lines 14 between terminals 18 and ground. Each resonator has a characteristic capacitance denoted by capacitor 20 and a characteristic inductance denoted by inductor 22, which are chosen so that the resonators 16 resonate at the desired frequency with the desired bandwidth. At the resonant frequency, there is very low impedance between the terminal and ground, such that the signals at or near that frequency are attenuated. The electrical length of each interconnecting transmission line is generally chosen to be on the order of one-quarter wavelength or three-quarter wavelength of the resonant frequency for the resonators.

While it is possible to design such resonant circuits for any frequency, frequencies having relatively long wavelengths and relatively narrow stopbands may be problematic. The necessary characteristics of the capacitors and the inductors may be such that they are difficult to implement, may lead to structures which exhibit unacceptable signal losses outside of the desired stopband, or may fail to adequately attenuate signals in the stopband. The use of high-temperature superconducting structures in electromagnetic devices has been suggested because of their low resistances once cooled to below a critical temperature. By using superconductors in stopband filters, dissipation within a stopband can be increased without additional losses outside the stopband.

Superconductors have numerous drawbacks, however. First, the only high-temperature superconducting structures known are ceramics, and it may be difficult to connect those structures with other elements in a circuit. If a superconducting inductor 22 is used in FIG. 1, it may be difficult to connect that inductor 22 to a ground. Moreover, the necessity of cooling the superconducting structures makes it impractical to design circuits having large superconducting elements. For instance, it may be necessary to design a portion of a resonant element with a wavelength which is approximately one-half or one-quarter the wavelength of the resonant frequency. For applications in the high-frequency (HF) band, on the order of 3 to 30 megahertz, the long wavelength may make it impractical to use a superconducting structure.

In addition, it may be desirable for a user of a filter to change the resonant frequency of the resonators to adjust the stopband for a filter. When superconducting components are used, the filter will be housed in a cryostat to maintain low temperature, making adjustments to the filter difficult. In some cases it may be impractical, depending on the structure of the components, to adjust the frequency.

SUMMARY OF THE INVENTION

In accordance with one aspect of the present invention, a radio frequency bandstop filter has a signal input, a signal output, and a terminal between the signal input and the signal output. A resonator having a resonant frequency with a corresponding wavelength is connected between the terminal and ground. The resonator has a first capacitor, a transmission line, and a second capacitor, where the first capacitor is coupled between the terminal and the transmission line. The second capacitor is coupled between the transmission line and ground, and the transmission line has an electrical length between a quarter and a half of the wavelength.

The transmission line may be made of a high-temperature superconducting material, and the transmission line may be helical. The transmission line may be formed discrete from any other structure. The superconducting material may be extruded and formed into a helix around a mandrel. The extruded material may be heat-treated to form a discrete helix, which may be supported by a low-loss tube.

The second capacitor may be adjustable to vary the resonant frequency. The filter may include a high-temperature superconducting material having a critical temperature, and the filter may be kept below the critical temperature by housing it in a cooling structure. The second capacitor may be adjustable by a user of the filter from outside the cooling structure.

The filter may have plurality of terminals and a plurality of resonant circuits with interconnecting means between the terminals. Each resonant circuit 13 is connected between a respective terminal and ground. There may be interconnecting transmission lines between the terminals and there may be low-pass ladder networks between the terminals.

In accordance with another aspect of the present invention, a resonant structure may include means for coupling a signal into the resonant structure. A helical element in the resonant structure is formed discrete from any other structure, and the helical element comprises a high-temperature superconductor. The helical element may include end tubes and may be mounted on a low-loss tubular stand.

Other features and advantages are inherent in the filter claimed and disclosed, or will become apparent to those skilled in the art from the following detailed description in conjunction with the accompanying drawings.

DETAILED DESCRIPTION

Figure 1:
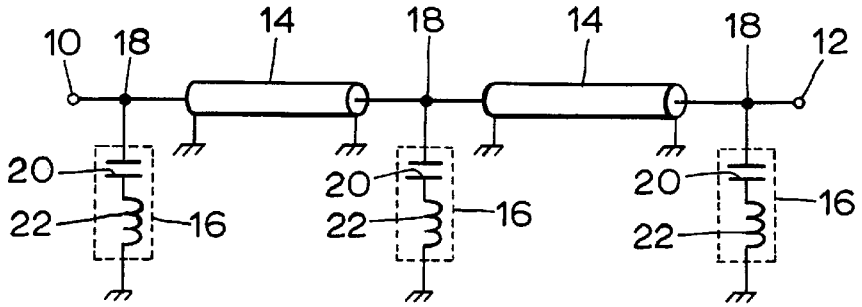
Fig. 1 PRIOR ART
FIG. 1 is a circuit diagram of a prior art bandstop filter.
Figure 2:
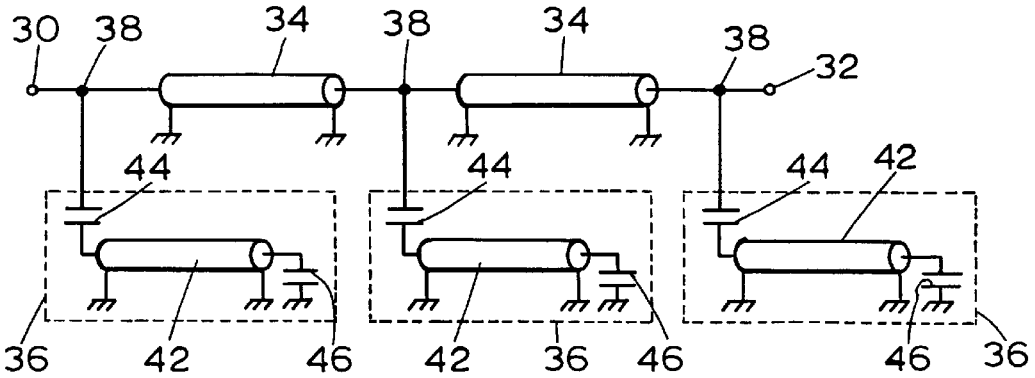
FIG. 2 is a circuit diagram of one embodiment of a bandstop filter of the present invention.

Referring initially to FIG. 2, a filter of the present invention includes an input 30 and an output 32 connected by interconnecting transmission lines 34. Three resonators 36 are connected to terminals 38 at the ends of the transmission lines 34. Each resonator 36 includes a transmission line 42 coupled to one of the terminals 38, through a capacitor 44. Opposite from its respective capacitor 44, each transmission line 42 is coupled through a second capacitor 46 to ground. As discussed below, the capacitors 44 and the capacitors 46 may be adjustable.

As in the prior art, the interconnecting transmission lines 34 are chosen to have an electrical length on the order of one-quarter or three-quarter wavelengths in the stopband, but each electrical length may vary from those values depending on the specific design parameters of the filter. The electrical length of the transmission lines 42 are chosen to be between one-quarter wavelength and one-half wavelength of the resonant frequency.

Figure 3:
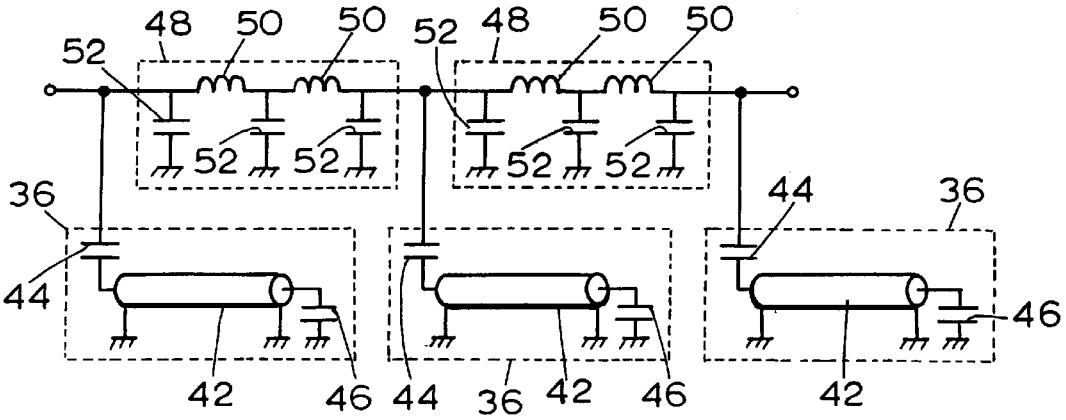
FIG. 3 is a circuit diagram of a second embodiment of a filter of the present invention.

When used at relatively low frequencies, the interconnecting transmission lines 34 may have to be extremely long in order to be one-quarter or three-quarters of a wavelength. Therefore, it may be desirable to construct the interconnecting transmission lines 34 in the form of equivalent low-pass ladder networks 48, as shown in FIG. 3. The low-pass ladder networks 48 contain inductors 50 with shunt capacitors 52 coupled to ground. If an equivalent low-pass ladder network 50 is not used, the interconnecting transmission lines 34 may be coaxial cable or any other convenient transmission line configuration. Elements shown in FIG. 3, such as the resonators 36, the transmission lines 42, and the capacitors 44 and 46, correspond with the structures first identified in FIG. 2 with like reference numerals.

The transmission lines 42 in the resonators 36 may be coaxial, stripline, slabline, microstrip, or coplanar, but are preferably helical and manufactured from a high-temperature superconducting material, as is discussed more fully below.

Figure 4:
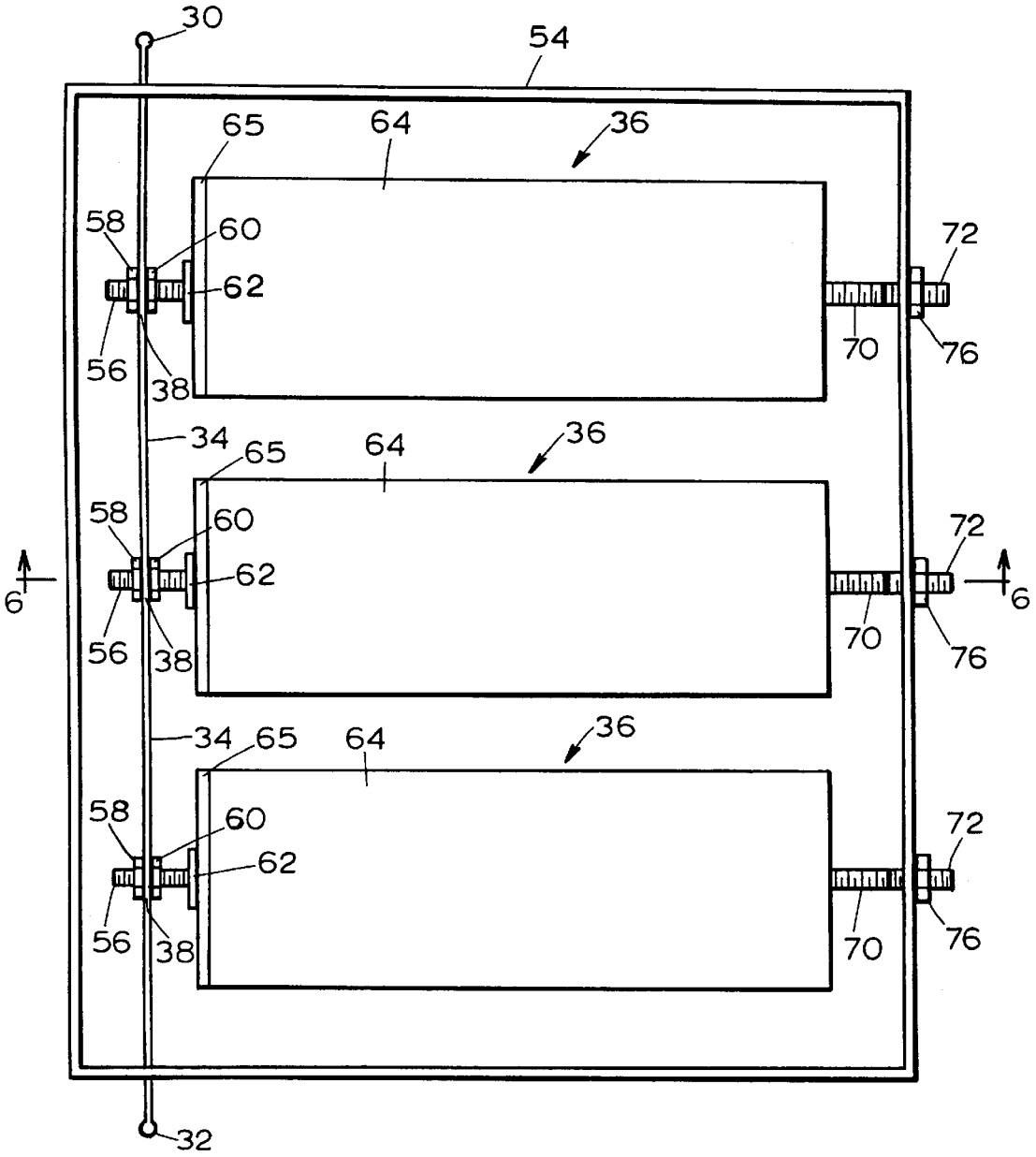
FIG. 4 is a top plan view of a filter of the present invention located in a cryostat.
Figure 5:
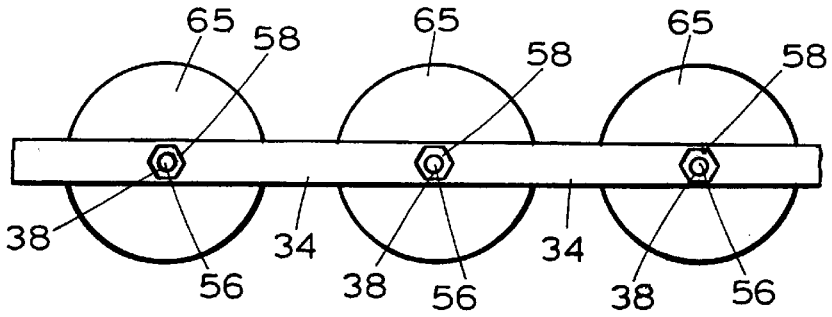
FIG. 5 is a front elevational view of the filter of FIG. 4.
Figure 6:
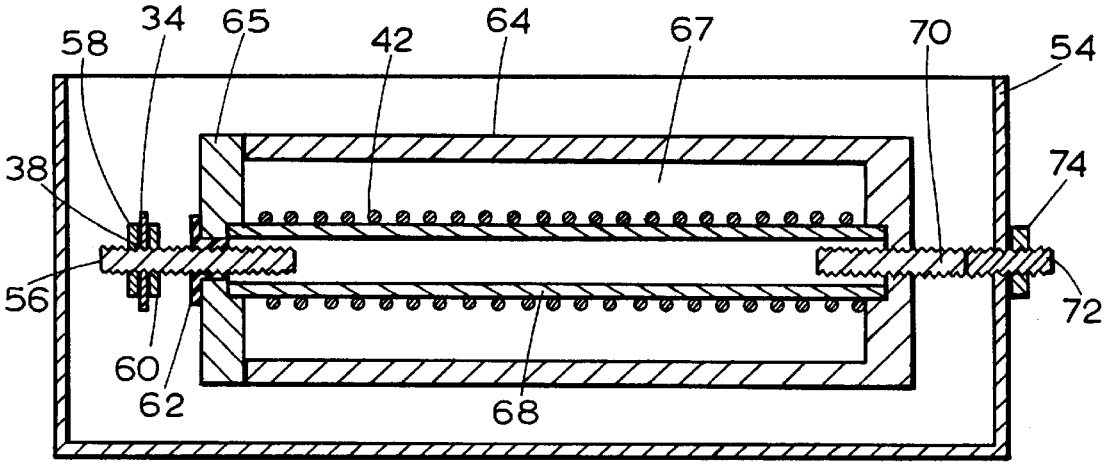
FIG. 6 is a cross-sectional view of the filter of FIG. 4 taken along the line 6—6.

FIGS. 4, 5, and 6 disclose one embodiment of a filter of the present invention. Elements shown in FIGS. 4, 5, and 6 have been provided with the numerals of the same structures shown in FIG. 2. The filter is housed in a cryostat 54 (FIGS. 4 and 6), which is designed to cool the filter to at or below the critical temperature of any superconducting material in the filter. The cryostat is shown with an open top so that the filter can be seen. Normally, the filter is supported off the walls of the cryostat by structure, which is not depicted. Outside the cryostat 54 are an input terminal 30 (FIG. 4) and an output terminal 32 (FIG. 4). Interconnecting transmission lines 34 are connected between the input terminal 30 and output terminal 32 from which resonators indicated generally at 36 are connected at terminals 38. The resonators 36 are each located in a housing 64 (FIGS. 4 and 6), and each housing has a cover 65. The resonators 36 are connected to the terminals 38 by floating screws 56, which pass through the ends of transmission lines 34. The floating screws 56 are not grounded and are held in place by nuts 58 and 60 (FIGS. 4 and 6) on each side of the transmission lines 34. As best seen in FIG. 6, the floating screws 56 pass through a bushing 62 and penetrate into a housing 64 through the cover 65. The bushings 62 are made of a non-electrically conductive material such as Teflon® or Ultem® so that the screws 56 are not in electrical contact with the cover 65, through which they pass. Teflon® is a fluorocarbon polymer (e.g., tetrafluoroethylene polymers or fluorinated ethylene-propylene resins) commercially available from DuPont of Wilmington, Del., while Ultem® is a family of engineered plastics based on polyetherimide resins commercially available from General Electric.

As seen in FIG. 6, each housing 64 has a cavity 67 which contains a helical transmission line 42. The transmission line 42 is supported by a non-conducting tube 68 made, for instance, of sapphire or a polycrystalline alumina, particularly a high-purity alumina such as Lucalox® manufactured by General Electric. The tube 68 is mounted in the housing 64 and the cover 65 to minimize movement of the tube 68 with respect to the housing 64. The tube 68 has an open interior so that the floating screw 56, passing through the bushing 62 and the cover 65 may also pass into the tube 68 adjacent the helical transmission line 42. Grounded screws 70 pass through threaded openings in the housings 64 and into the respective tubes 68 at the end of the tubes 68 opposite from the floating screws 56. Each grounded screw 70 has an insulated end 72 which passes through an unthreaded opening in the cryostat 54. Locknuts 74 secure the screws 70 once they have been adjusted, as described below. The insulated portion 72 is desirable so that heat does not pass from outside to inside the cryostat 54, via the grounded screws 70. The floating screws 56 and the grounded screws 70 are desirably made of metal, for instance, stainless steel or brass, and coated with a low-loss metal such as silver. Such screws are an excellent thermal conductor. The insulated portion 72 on each grounded screw 70, therefore, should be made of non-conductive material, such as an epoxy/fiberglass composite like G10 (a common commercial grade material as specified by the National Electrical Manufacturers Association).

The floating screws 56 and the grounded screws 70 serve as adjustable capacitors at either end of the transmission lines 42. The floating screws 56 are electrically connected to the transmission lines 34, and therefore serve as the capacitors 44 in FIGS. 2 and 3. The floating screws 56 can be removed from or inserted into the tube 68 to change the capacitance between the floating screws 56 and their respective transmission lines 42. Similarly, the grounded screws 70 may be inserted or removed from their respective tubes 68 in order to adjust the capacitance between the grounded screws 70 and the transmission lines 42. Each grounded screw 70 passes through the housing 64, but is not insulated from the housing 64, as the floating screws 56 are insulted from the covers 65 by the bushings 62. Therefore, the grounded screws 70 form grounded capacitors between the screws 70 and the transmission lines 42.

Each resonator 36 may be tuned to its proper bandwidth and center frequency by adjusting the floating screw 56 and the grounded screw 70. In general, the grounded screw 70 will adjust the center frequency, and the floating screw 56 will adjust the bandwidth. However, each screw will have some effect on both characteristics, and therefore, an iterative process is usually undertaken to adjust both screws. Once a resonator 36 is tuned, it may be detuned by removing the screw 70 a sufficient distance from the transmission line 42. Each of the other resonators 36 may then be tuned in a similar fashion. Once all three resonators 36 have been tuned, each detuned resonator 36 may be retuned by adjusting the screws 70 on each of the resonators 36. Since each of the screws 70 passes through the cryostat, a user of such a filter may adjust those frequencies and thereby place the stopband, as desired, over a wide frequency range. Thus, the filter of the present invention is selectively tuned by a user, unlike many filters in the prior art.

Figure 7:
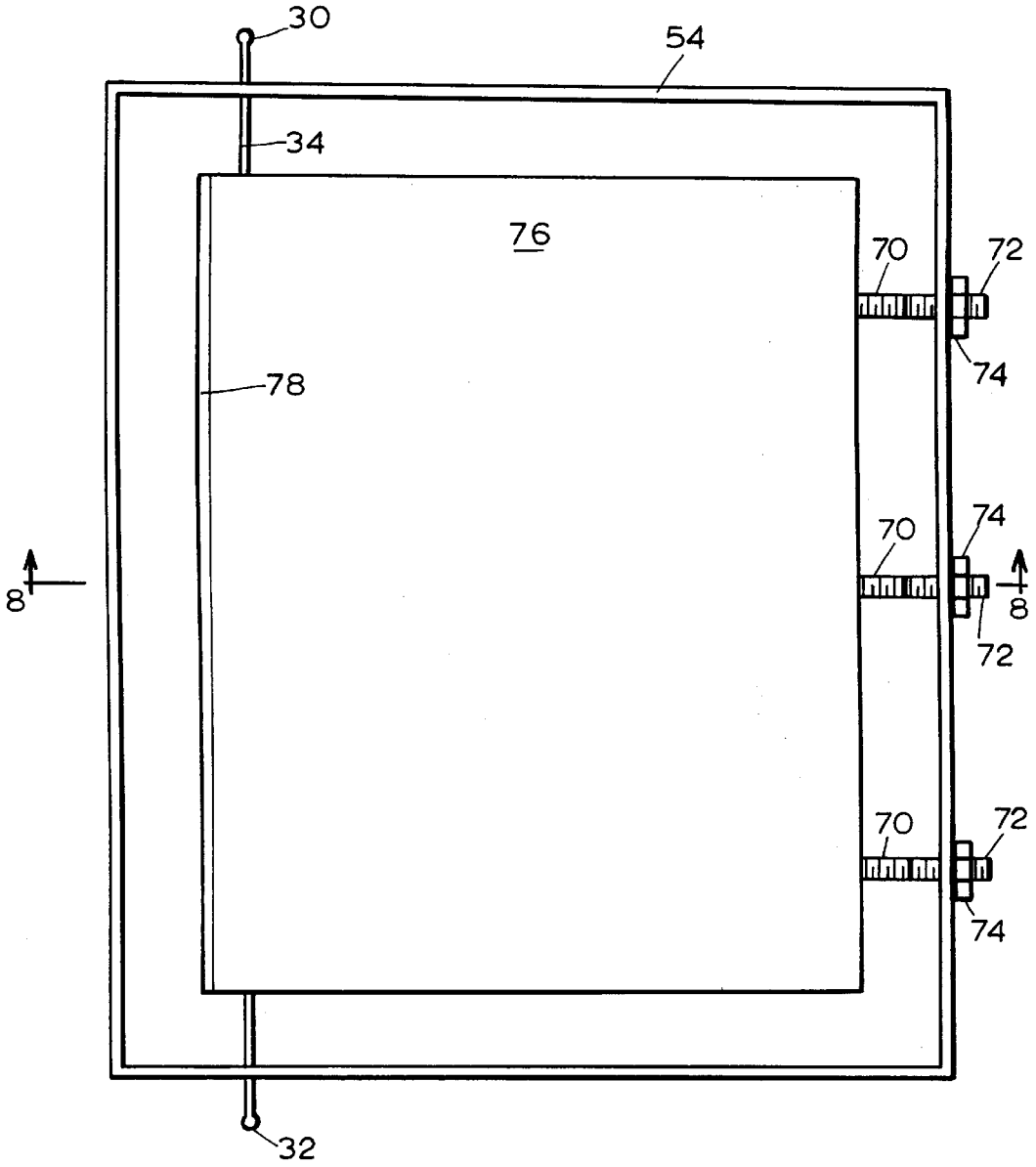
FIG. 7 is a top plan view of an embodiment of a bandstop filter of the present invention.
Figure 8:
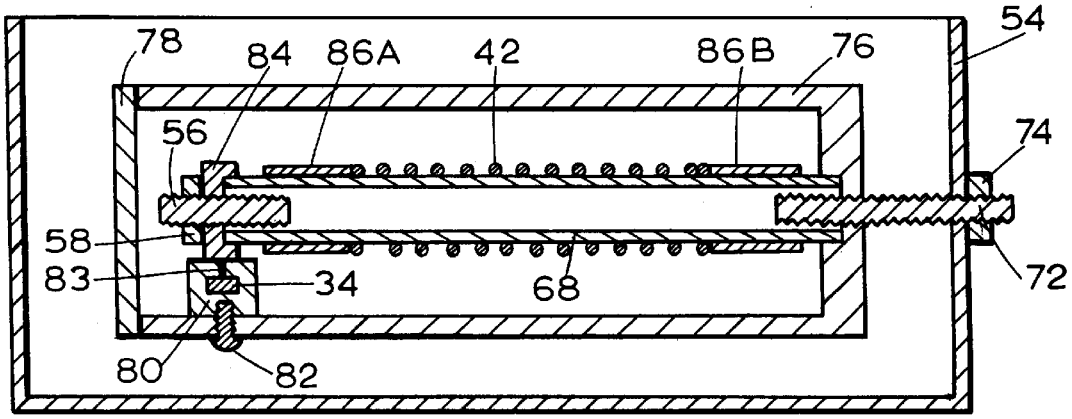
FIG. 8 is a cross-sectional view of the filter of FIG. 7 taken along the line 8—8.

Referring now to FIGS. 7 and 8, a second embodiment of a filter of the present invention has a single housing 76 and single cover 78, which contains all three resonant circuits 36. Elements of FIGS. 7 and 8 have been provided with the numerals of the same structures shown in FIGS. 2, 4, 5, and 6, such that, for example, the screws 70, the insulated portion 72, and the locknuts 74 correspond with the structures identified hereinabove with like reference numerals. The embodiment of the filter shown in FIG. 7 has an input 30 and an output 32, and interconnecting transmission lines 34 connected between the input and output. The filter is surrounded by a cryostat 54, which is used to cool the filter to at or below the critical temperature of any superconducting material in the filter. As seen in FIG. 8, the transmission lines 34 pass through a standoff 80, which holds the interconnecting transmission lines 34. The standoff 80 is made of an electrically insulating material and is connected to the housing 76 by one or more screws 82. A brass or copper pin 83 is soldered to the transmission line 34 and to a copper terminal 84. The terminal 84 has an opening through which a floating screw 56 passes and is secured by a locking nut 58. The floating screw 56 passes into a tube 68, which houses the transmission line 42. The floating screws 56 are thus electrically connected to the interconnecting transmission lines 34 and serve as the capacitors 44 in FIGS. 2 and 3.

Unlike the embodiment shown in FIG. 6, the embodiment in FIG. 8 has tubes 86A and 86B made of high-temperature superconducting material at each end of the transmission line 42. The tubes 86 are connected to the transmission line 42 and are ideally made of the same material as the transmission line 42. The tube 86A serves to increase the capacitance between the floating screw 56 and the transmission line 42. The embodiment of the filter shown in FIG. 8 has grounded screws 70, which pass through the housing 76 and through the cryostat 54, and are secured by locking nuts 74. The grounded screws 70 in FIGS. 7 and 8 also have respective insulated portions 72, which minimize thermal conductivity through the cryostat 54. The tube 86B located adjacent the grounded screw 70 serves to increase the capacitance between the transmission line 42 and the grounded screw 70.

The filter of FIGS. 7 and 8 is tuned similarly to the filter of FIGS. 4–6. Access to the floating tuning screw 56 is limited by the fact that the cover 78 must be removed from the housing 76 in order to adjust the floating tuning screw 56. Access to the grounded screw 70, however, is identical to the embodiment shown in FIGS. 4–6 so that a user can relatively easily modify the resonant frequency of each resonant circuit 36.

The helical shape of the transmission line 42 in each of the embodiments is desirable because it permits the use of a relatively long transmission line in a relatively small amount of space. For instance, a 3-megahertz signal has a wavelength of approximately 100 meters. Therefore, an unloaded transmission line (without the effect of the capacitance at either end) would need to be 25–50 meters long. Loading may significantly reduce that length, but the transmission line may still be impractically long for any filter, much less a superconducting structure which requires cooling. By using a helical transmission line, the overall length may be greatly reduced.

Forming such a helical transmission line out of a high-temperature superconducting material, however, may be difficult. Thin film or thick film superconductor coating techniques that are currently available may not be satisfactory. Thin film techniques, which deposit a layer of superconductor on a substrate where the superconducting material then adopts the crystalline structure of the substrate, are greatly limited by the type of substrates which can be used. A substrate which has a desirable crystalline structure may have a high dielectric loss, and therefore be unsuitable as a support tube for the superconductor. The support tube will be exposed to the electromagnetic fields around the helix and may result in signal losses. Similarly, thick film techniques in which a coating is applied to a substrate may also be undesirable because the substrate used may also have a high dielectric loss. Thick film techniques usually heat the superconductor and substrate which can lead to undesirable reactions between the superconductor and substrate. A conventional thick film substrate which does not react with the superconductor may have a high loss. It is therefore desirable to form the helix as a discrete part, which can then be supported by a material such as sapphire or Lucalox® having a low dielectric loss.

In order to manufacture the helical transmission line, an extrusion is made consisting of 15 wt. % plasticizer (Santicizer 160), 35 wt. % thermoplastic resin (Butvar 90), and 50 wt. % $YBa_2Cu_3O_x$ powder, where x is between about 6.5 and about 7.2, (Superamic Y123HP from Rhone-Poulenc). The plasticizer and thermoplastic resin are melted together at 150° C., and then the YBCO powder is added to form a mixture. The mixture is extruded at 165° C. through a 0.040-inch (1 mm) diameter circular dye to obtain long, flexible fibers. The fibers may be wound onto a spool as they are extruded. The fibers are formed into a helical coil by being wound onto a mandrel, which will have a length and diameter chosen for the desired frequency range. If a frequency range from 14 to 16 Mhz is desired, the diameter of the mandrel may be about 1-inch (2.54 cm) and should be long enough to accept 5½ inches (14 cm) of fibers. The fibers are wound around the mandrel at 25 windings per inch for a total length of windings of about 432 inches (10.97 m).

The fibers and mandrel are then heated to about 150° C. for about 15 hours to drive off most of the plasticizer. The coil can then be removed from the mandrel, and will hold its shape. The dried and stiffened coil is then subjected to the heating cycle set forth in Table 1 to burn off the remaining thermoplastic components. The heating cycle begins at room temperature, and each step has a specified rate of rise from the previous step, a final temperature for that step, and the length of time that the coil is held at the final temperature for the step. In addition, Table 1 also provides the percent oxygen in the furnace for each step. The pressure in the furnace is one atmosphere for all steps in Table 1, and the oxygen is always mixed with nitrogen.

TABLE 1

| Steps | Rate of Increase From Previous Step | Final Temperature | Hold Time | Oxygen Percent |
|---|---|---|---|---|
| 1 | 200°/hour | 150° C. | 15 hours | .25% |
| 2 | 10°/hour | 240° C. | 0 hours | .25% |
| 3 | 2°/hour | 300° C. | 0 hours | 2% |
| 4 | 10°/hour | 440° C. | 0 hours | 2% |
| 5 | 5°/hour | 750° C. | 15 hours | 2% |
| 6 | 200°/hour | 810° C. | 2 hours | .25% |
| 7 | 200°/hour | 20° C. | — | 2% |

It may be desirable to add additional low-pressure oxygen heat treatment steps after Step 6 described in Table 1. In such a case, the temperature is raised at 100° C. per hour to 930° C. and held there for a half-hour in 0.001 atmosphere of pure oxygen (no nitrogen present). The temperature is then raised at 100° C. per hour to 950° C., and held there from 15–60 minutes (depending on the size of the coil) at 0.001 atmosphere of pure oxygen. The oxygen pressure is then slowly raised over a 24-hour period from 0.001 atmosphere to 1 atmosphere. After 24 hours, the coil is cooled at 200° C. per hour to room temperature.

After the heating cycle, or modified heating cycle, described above, the coil is submitted to an oxygenation cycle set forth in Table 2 below. All steps in Table 2 are at 100% oxygen at 1 atmosphere.

TABLE 2

| Step | Rate of Increase From Previous Step | Final Temperature | Hold Time |
|---|---|---|---|
| 1 | 50°/hour | 150° C. | 0 hours |
| 2 | 20°/hour | 500° C. | 0 hours |
| 3 | 50°/hour | 795° C. | 0.3 hours |
| 4 | 50°/hour | 700° C. | 0.5 hours |
| 5 | 100°/hour | 610° C. | 1 hour |
| 6 | 100°/hour | 520° C. | 2 hours |
| 7 | 100°/hour | 450° C. | 24 hours |
| 8 | 200°/hour | 220° C. | — |

If a helical transmission line as shown in FIGS. 7 and 8 is used, the tubes 86 on either end of the transmission line 42 may be made of the same material as the transmission line 42. The tubes may be constructed by simply winding the extruded material at 100% density, i.e. with no space between the windings, when the extrusion is wrapped around the mandrel. Alternatively, the tubes 86 could be made separately from the transmission line 42 and then the ends of the transmission line are pressed into the tubes before the plasticizer is removed.

A transmission line made in accordance with the above method can be easily removed from the mandrel, and is thus formed as a discrete part. The fact that the transmission line has signals coupled to and from it capacitively means that it is not necessary to directly connect the superconducting material to any non-superconducting component.

The exact dimensions of the structures in the filter of the present invention will of course be dependent on the desired filtering frequency range. In addition, modifications to various components may modify the desired size for other components. The length of the transmission lines 34 as shown in FIGS. 4–6 may not be to scale if filtering of relatively long wavelengths is desired. It may be preferable to use the low-pass ladder networks shown in FIG. 3, or at least use a helical coil for the transmission line 34 to reduce the space which might be needed between cavities to accommodate the transmission line. If a 14–16 Mhz filter is desired, the housing 64 may be designed to have a cavity which is 8 inches long and 4 inches in diameter. Although $YBa_2Cu_3O_x$ is the preferred material for the transmission line, other superconducting materials may also be used.

The foregoing detailed description has been given for clearness of understanding only, and no unnecessary limitations should be understood therefrom, as modifications would be obvious to those skilled in the art.

We claim:

1. A radio-frequency bandstop filter comprising:

a signal input;

a signal output;

a terminal between the signal input and the signal output; and a resonator having a resonant frequency with a corresponding wavelength connected between the terminal and ground;

wherein the resonator comprises a first capacitor, a transmission line, and a second capacitor;

the first capacitor is coupled between the terminal and the transmission line;

the second capacitor is coupled between the transmission line and ground; and the transmission line has an electrical length between but exclusive of a quarter and half of the wavelength.

2. The filter of claim 1 wherein the transmission line comprises a high-temperature superconducting material.

3. The filter of claim 2 wherein the transmission line is a helical transmission line.

4. The filter of claim 3 wherein the transmission line is an element which is discrete from any other structure.

5. The filter of claim 4 wherein:

the superconducting material is extruded;

the extruded material is formed into a helix around a mandrel; and the extruded material is heat-treated to form a discrete helix.

6. The filter of claim 5 comprising a low-loss tube supporting said helix.

7. The filter of claim 1 wherein the second capacitor is adjustable to vary the resonant frequency.

8. The filter of claim 1 wherein:

the transmission line comprises a high-temperature superconducting material having a critical temperature;

the filter is kept below the critical temperature by locating the filter in a cooling structure, and the second capacitor is adjustable from outside the cooling structure.

9. The filter of claim 1 comprising:

a further multitude of terminals between the signal input and the signal output;

interconnecting means between the terminals; and a plurality of resonant circuits wherein each circuit is connected between a respective terminal and ground.

10. The filter of claim 9 wherein the interconnecting means comprises respective interconnecting transmission lines between adjacent ones of the terminals.

11. The filter of claim 9 wherein the interconnecting means comprises respective low-pass ladder networks between adjacent ones of the terminals.

12. A resonant structure having a resonant frequency with a corresponding wavelength comprising:

means for coupling a signal into the resonant structure; and a helical element in the resonant structure wherein the helical element is an element which is discrete from any other structure, and the helical element comprises a high-temperature superconductor and end tubes wherein the helical element has an electrical length between but exclusive of a quarter and half of the wavelength.

13. The resonant structure of claim 12, further comprising an adjustable capacitor coupled to the helical element that tunes the resonant frequency of the resonant structure.

14. The resonant structure of claim 12 wherein the helical element is mounted on a low-loss tubular stand.

15. A bandstop filter comprising:

an input terminal;

an output terminal; and a resonator having a resonant frequency with a corresponding wavelength and coupling the input terminal and the output terminal to ground;

wherein:

the resonator comprises a first adjustable capacitor, a transmission line, and a second adjustable capacitor;

the first adjustable capacitor couples the transmission line to the input terminal and the output terminal;

the second adjustable capacitor couples the transmission line to ground; and the transmission line has an electrical length between but exclusive of a quarter and half of the wavelength.

16. The bandstop filter of claim 15, wherein the transmission line comprises a high-temperature superconducting material.

17. The bandstop filter of claim 15, wherein the transmission line comprises a helical element.

18. The bandstop filter of claim 17, wherein the helical element is mounted on a low-loss, tubular stand.

19. The bandstop filter of claim 17, wherein the helical element comprises end tubes.

* * * * *